United States Patent [19]

Nardella et al.

[11] Patent Number: 4,618,118

[45] Date of Patent: Oct. 21, 1986

[54] RELEASABLY LOCKING

[75] Inventors: Michael A. Nardella, Millbury; Bernard T. Cournoyer, Holden, both of Mass.

[73] Assignee: Barry Wright Corporation, Newton Lower Falls, Mass.

[21] Appl. No.: 720,839

[22] Filed: Apr. 8, 1985

[51] Int. Cl.[4] ..... A47G 29/02

[52] U.S. Cl. ..... 248/243; 211/192

[58] Field of Search ..... 248/243; 108/110, 107; 211/187, 192; 292/163

[56] References Cited

U.S. PATENT DOCUMENTS 1,065,004 6/1913 Senge ..... 248/243 X 4,171,789 10/1979 Vander Hoek et al. ..... 248/243

*Primary Examiner*—J. Franklin Foss

*Assistant Examiner*—Blair M. Johnson

*Attorney, Agent, or Firm*—Gary E. Ross

[57] ABSTRACT

A latch housing of molded plastic has a flanged surface that makes surface contact around a rectangular cutout in a dimpled or recessed area of a metal panel flush with the panel surface. Four extended retainers having a lightly tapered bottom edge retain the housing in the panel. A latch having a stepwise tapered end resides within the housing with the end passing through a vertical slot in a rear wall of the housing. A spring is connected between an integral hook on the housing and the forward end of the latch to keep the latch normally in the locked position. An opening in the housing allows a finger to engage the latch and release it from the locked position.

8 Claims, 3 Drawing Figures

RELEASABLY LOCKING

The present invention relates in general to releasably locking and more particularly concerns novel apparatus and techniques for detachably securing hangar bar panels of a type used in hanger systems comprising adjustable shelves carried by vertical panels formed with a vertical array of notches for accepting hooks and latches usually carried by end panels depending from a shelf. The present invention is relatively easy and inexpensive to manufacture and install, relatively easy to operate by unskilled personnel and positively assumes a locked position unaided when attaching to a wall bracket while maintaining the locked position unless held in the unlocked position. Release from the unlocked position to facilitate removal is easily attained by finger pressure.

U.S. Pat. No. 4,171,789 discloses a prior art arrangement having a spring-biased lock for locking a shelf unit into engagement with apertures in the support. A detent holds the lock in an unlocked position when engaged. The lock and the support also include an automatic release system for releasing the detent when the unit is first hooked into the support to move the lock into the locked condition. The locking bar is formed with a central circular opening for accommodating a finger and having a tab above the opening for connecting one end of a biasing spring having its other end connected to the rear of the locked housing. The rear of the locking bar is formed with a notch for engagement with the rear wall of the housing to keep the locking bar in the unlocked position when moved forward and upward. Insertion of an associated shelf unit into an aperture lifts the rear end of the locking bar upward and allows the spring to move it rearward into engagement with an aperture in the support members attached to the wall.

It is an important object of this invention to provide improved methods and means for releasably locking.

According to the invention, there is lock housing means formed with latch guide means for slidably supporting latch means for selectively engaging an aperture in a vertical support member, spring boss means for anchoring one end of spring means for urging said latch means rearward and sideward and travel limit boss means for limiting the rearward travel of the latch means. The housing means is formed with an opening for providing access to the latch means to selectively move the latch to the unlocked position. A feature of the invention resides in forming the housing as a snap-in assembly that fits into an aperture in the end panel to facilitate its installation.

Figure 2:
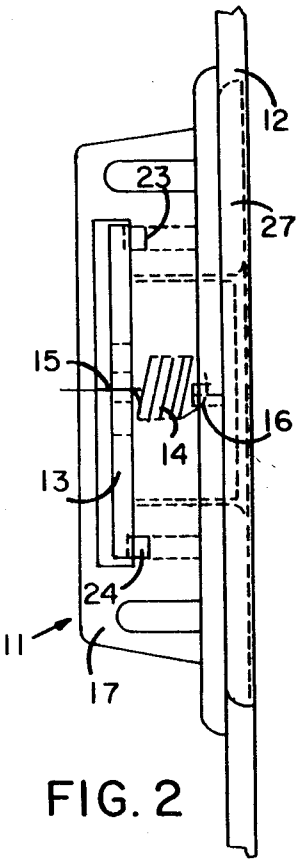
Figure 1:
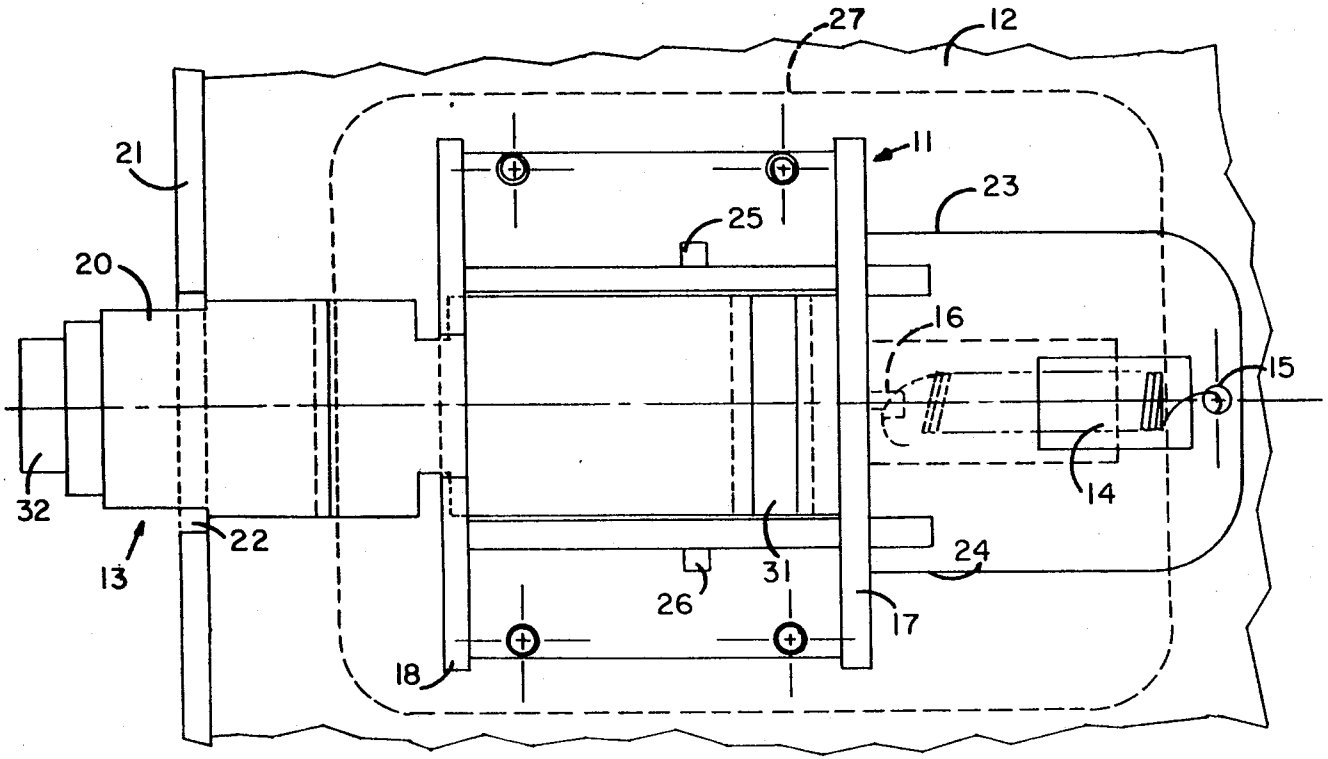
Figure 3:
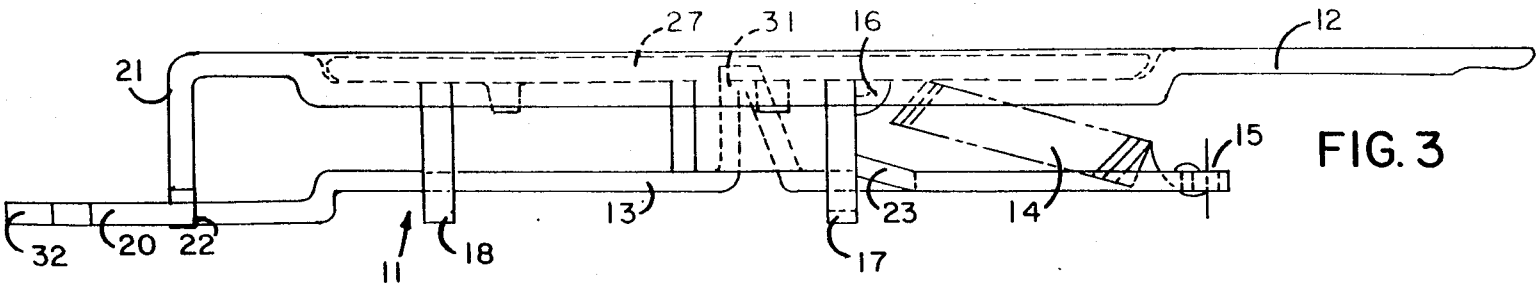

Numerous other features, object and advantages of the invention will become apparent from the following specification when read in connection with the accompanying drawing in which:

FIGS. 1, 2 and 3 are elevation, end and top views, respectively, of an exemplary embodiment of the invention.

With reference now to the drawing and more particularly FIGS. 1, 2 and 3 thereof, there is shown elevation, end and top views, respectively, of an exemplary embodiment of the invention. The invention comprises a housing 11 that snap-fits into an opening in end panel 12 typically of a shelf supporting structure. Lock housing 11 slidably supports a latch 13. A spring 14 is connected between the forward end 15 of latch 13 and spring boss 16 of housing 11 adjacent to panel 12. Housing 11 is formed with forward and intermediate vertical slotted supports 17 and 18, respectively, with the rear wall 21 formed with a notch 22 at its inside end for accommodating the rear end 20 of latch 13 to allow latch 13 to move away from end panel 12 in a manner described below.

Latch 13 is formed with upper and lower ears 23 and 24, respectively, bent toward panel 12 to function as latch catch bosses that engage forward support 17 when in the unlocked position and upper and lower travel limit bosses 25 and 26, respectively, when in the locked position. Vertical slotted supports 17 and 18 are formed with slots wide enough to allow latch 13 to move perpendicular to its plane so that ears 23 and 24 may pass through these slots. They thus comprise guide means that allow more movement of latch 13 along its length than perpendicular to its plane. The latch and spring may first be assembled into housing 11 as shown to form an assembled locking assembly that may then be press-fit into a recessed opening in end panel 12 with base 27 of housing 11 coplanar with the plane of end panel 12 as best seen in FIGS. 2 and 3.

Latch 13 is also formed with a generally V-shaped trigger portion 31 extending toward base 27 to facilitate rearward finger pressure on latch 13 to move it toward the locked position. Latch 13 is tapered stepwise at its rear end 32 to facilitate entry into a mating aperture in the wall support.

Having described the structural arrangement of the invention, its mode of operation will be described. The invention is shown in the drawing in the locked position with ears 23 and 24 engaging forward support 17. Spring 14 exerts a force on latch 13 both rearward and sideward toward panel 12 to keep latch 13 in the locked position. To move latch 13 to the unlocked position, one need only push with a finger through the opening 27' in base 27 to engage slide 13, pushing it forward with pressure on trigger portion 31.

Latch 31 is preferably made of steel. Housing 11 is preferably molded of plastic, such as acetal DuPont Delrin 500 Cl. Other materials and other forms of springs may be used. However, it is preferred that the spring be located as best seen in FIG. 3 in the region between base 27 and latch 13 so that it may exert a force both sideward toward base 27 and rearward toward the rear of the housing to perform the functions described.

The different elements of the combination perform a number of multiple functions. Lock housing 11 functions as a mounting device, a housing for slidably supporting latch 13, a holding device for spring 14 and as part of the latching mechanism. Latch 13 functions as a sliding bar for the actual locking insertion and interference with the vertical wall support, and as a finger triggering device to unlock the lock. Spring 14 serves the dual purpose of maintaining a bias on latch 13 to maintain the locked position.

Summarizing operation and features, the plastic molded latch housing allows a metal panel having a rectangular cutout within a dimpled or recessed area to retain the housing. A flanged surface on the face may make surface contact around the cutout, fitting within the dimples or recessed area flush with the panel surface to avoid presenting an obstruction. Four extended retainers bend inward on insertion through the rectangular opening and then return to their undeflected condition to keep the housing in position unstressed. Making the bottom edge of the retainers on a slight incline or graduation facilitates retention for a range of panel thicknesses. A slot or opening on each vertical surface allows insertion of the latch for containment within the housing as a complete assembly.

Spring 14 connected between the extreme end of the latch and an integral hook on the housing keeps the latch in the rear or locking position so that it automatically engages an opening within the panel system. Yet unlatching the latch is relatively easy when desired by inserting a finger into an opening of the housing, engaging a tab on the latch and forcing it toward the front, whereby causing the latch to be disengaged from the opening on the panel system. Spring 14 promptly repositions the latch to the locked position upon releasing the latch tab.

As the panel is being assembled to a panel system, the rear end of the latch will automatically retract toward the front position and then into the rear locked position through an opening in the panel system. The latch need not fully or totally engage the opening provided in the panel system. The structural arrangement inhibits accidental removal of a component from the system which might otherwise cause personal injury.

The invention thus has a number of advantages and features. It is relatively easy and inexpensive to fabricate and may be firmly placed in place without welding to facilitate inexpensive easy assembly. The housing base 27 may carry operating instructions molded-in to eliminate applique costs and enhance permanency of the instructions. A simple finger operating mechanism is so arranged as to protect the finger from the operating mechanisms. The lock is readily and easily changed between locked and unlocked position. The physical structure is relatively compact and suitable for retrofitting in existing panels.

It is evident that those skilled in the art may now make numerous uses and modifications of and departures from the specific apparatus and techniques disclosed herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. Apparatus for releasably locking comprising, latch means for moving between locked and unlocked positions to selectively engage a mating aperture, housing means including guide means for slidably supporting said latch means while allowing significant movement both along the length of said latch means and perpendicular to the plane thereof and having base means having a base panel generally parallel to the plane of said latch means with said base means for engagement with an end panel to be releasably locked by said apparatus, said guide means allowing more movement along the length of than perpendicular to the plane of said latch means, said housing means having travel limit means for limiting travel of said latch means along the length thereof, said latch means having travel limit boss means for selective engagement with said travel means in a locked rearward position, and spring means connected between said base means and said latch means located in the region between the plane of said latch means and said base panel for exerting a force on said latch means tending to urge said latch means both rearward along and sideward perpendicular to the latch means plane toward said base panel to keep said latch means travel limit boss means in engagement with said travel limit means when in said locked and unlocked positions.

2. Apparatus for releasably locking in accordance with claim 1 wherein said base means is formed with a finger opening exposing said latch means, and said latch means is formed with trigger means extending toward said base means for receiving finger pressure for moving said latch means from said locked to said unlocked position.

3. Apparatus for releasably locking in accordance with claim 2 wherein said travel limit means comprises, rearward travel limit means for engaging said travel limit boss means when in the locked position.

4. Apparatus for releasably locking in accordance with claim 1 wherein said spring means is connected between the forward end of said latch means and an anchor point of said housing forward of said guide means.

5. Apparatus for releasably locking in accordance with claim 1 wherein the rear end of said latch means is tapered stepwise.

6. Apparatus for releasably locking in accordance with claim 1 wherein said housing means is formed with a notch in a rear wall thereof for allowing said latching means to move therethrough.

7. Apparatus for releasably locking in accordance with claim 3 wherein said travel limit means further comprises forward travel limit means for engaging said travel limit boss means when in the unlocked position.

8. Apparatus for releasably locking in accordance with claim 7 wherein said guide means comprises a member generally perpendicular to said base panel formed with a normally vertical slot in which a forward portion of said latching means resides and comprising said forward travel limit means, said travel limit boss means comprising at least one ear extending from the forward portion of said latch means bent toward said base panel with the distance between the end of said ear and the plane of the forward portion of the latch means less than the thickness of said slot so that the forward portion of said latch means including said ear may slide through said slot until the ear end engages said rearward travel limit means with said spring means urging said latch means rearward and toward said base panel while moving said latch means forward so that the ear end moves forward of said slot and allows said spring means to urge said latch means sideward toward said base panel and allow the end of said ear to engage a portion adjacent said slot toward said base panel to keep said latch means in said unlocked position, whereby pressure on said latch means in a direction perpendicular to the latch means plane moves the ear end away from said base panel and allows said spring means to urge said latch means rearward with said ear passing through said slot.

* * * * *